US006439398B1

(12) United States Patent
Yang

(10) Patent No.: US 6,439,398 B1
(45) Date of Patent: Aug. 27, 2002

(54) CONVERTIBLE BOARD HOLDER

(76) Inventor: Chun-Tse Yang, 10, Alley 1, Lane 3, Wen-Chien Road, Niao-Sung Hsiang, Kaohsiung County (TW)

( * ) Notice: Subject to any disclaimer, the term of this patent is extended or adjusted under 35 U.S.C. 154(b) by 0 days.

(21) Appl. No.: 09/752,030

(22) Filed: Dec. 29, 2000

(51) Int. Cl.[7] ..... A47F 5/00
(52) U.S. Cl. ..... 211/41.1; 211/40; 206/587
(58) Field of Search ..... 211/41.1, 41.12, 211/41.14, 40; 206/453, 454, 586, 587

(56) References Cited

U.S. PATENT DOCUMENTS 2,989,189 A * 6/1961 Leone
3,807,622 A * 4/1974 Belcher et al.
3,990,624 A * 11/1976 Melli
4,231,473 A * 11/1980 Aprahamian ..... 206/387
6,010,007 A * 1/2000 Moren et al. ..... 206/587
6,142,304 A * 11/2000 Moren et al. ..... 206/587

* cited by examiner

*Primary Examiner*—Robert W. Gibson, Jr.
(74) *Attorney, Agent, or Firm*—Senniger, Powers, Leavitt & Roedel

(57) ABSTRACT

The present invention relates to a convertible board holder for positioning and cushioning at least one article each having two continuous side walls. The convertible board holder comprises a first portion, a second portion and a hinged portion. The first portion has at least one first transverse recess. The second portion has at least one second transverse recess corresponding to the first transverse recess of the first portion. The hinged portion continuously connects between the first portion and the second portion in a corrugated form so that when the first portion and the second portion are rotationally converted about the hinged portion at a certain angle, the first transverse recess and second transverse recess are adapted to receive the two side walls of the article, respectively. Therefore, the convertible board holder of the invention can position and cushion at least two side walls of an article. The convertible board holder can position and cushion a plurality of articles. The cost of the convertible board holder is low and the effect of the convertible board holder can be improved.

5 Claims, 3 Drawing Sheets

CONVERTIBLE BOARD HOLDER

BACKGROUND OF THE INVENTION

1. Field of the Invention

The present invention relates to a holder, more particularly, to a convertible board holder.

2. Description of the Related Art

The conventional packaging element can only position and cushion one side of an article. If both sides of the article are needed to be positioned and cushioned, two packaging elements must be manufactured to fit such a purpose. The cost is high, and the packaging effect also is not good. Therefore, it is necessary to provide a convertible board holder for packaging at least two sides of an article.

SUMMARY OF THE INVENTION

One objective of the present invention is to provide a convertible board holder for positioning and cushioning at least one article each having two continuous side walls. The convertible board holder comprises a first portion, a second portion and a hinged portion. The first portion has at least one first transverse recess. The second portion has at least one second transverse recess formed corresponding to the first transverse recess of the first portion. The hinged portion continuously connects between the first portion and the second portion in a corrugated form so that when the first portion and the second portion are rotationally converted about the hinged portion at a certain angle, the first transverse recess and second transverse recess are adapted to receive the two side walls of the article, respectively. Therefore, the convertible board holder of the invention can position and cushion at least two side walls of article.

Another objective of the present invention is to provide a convertible board holder. The convertible board holder can be manufactured to package at least two side walls of article. Therefore, the cost of the convertible board holder is low and the effect of the convertible board holder can be improved.

Still another objective of the present invention is to provide a convertible board holder. The convertible board holder comprises a first portion, a second portion and a hinged portion. The first portion has a plurality of first transverse recesses with a plurality of ribs disposed to separate the first transverse recesses apart from each other. The second portion has a plurality of second transverse recesses with a plurality of corresponding ribs disposed to separate the second transverse recesses apart from each other. Therefore, the convertible board holder can position and cushion a plurality of articles.

DETAILED DESCRIPTION OF THE INVENTION

Figure 1:
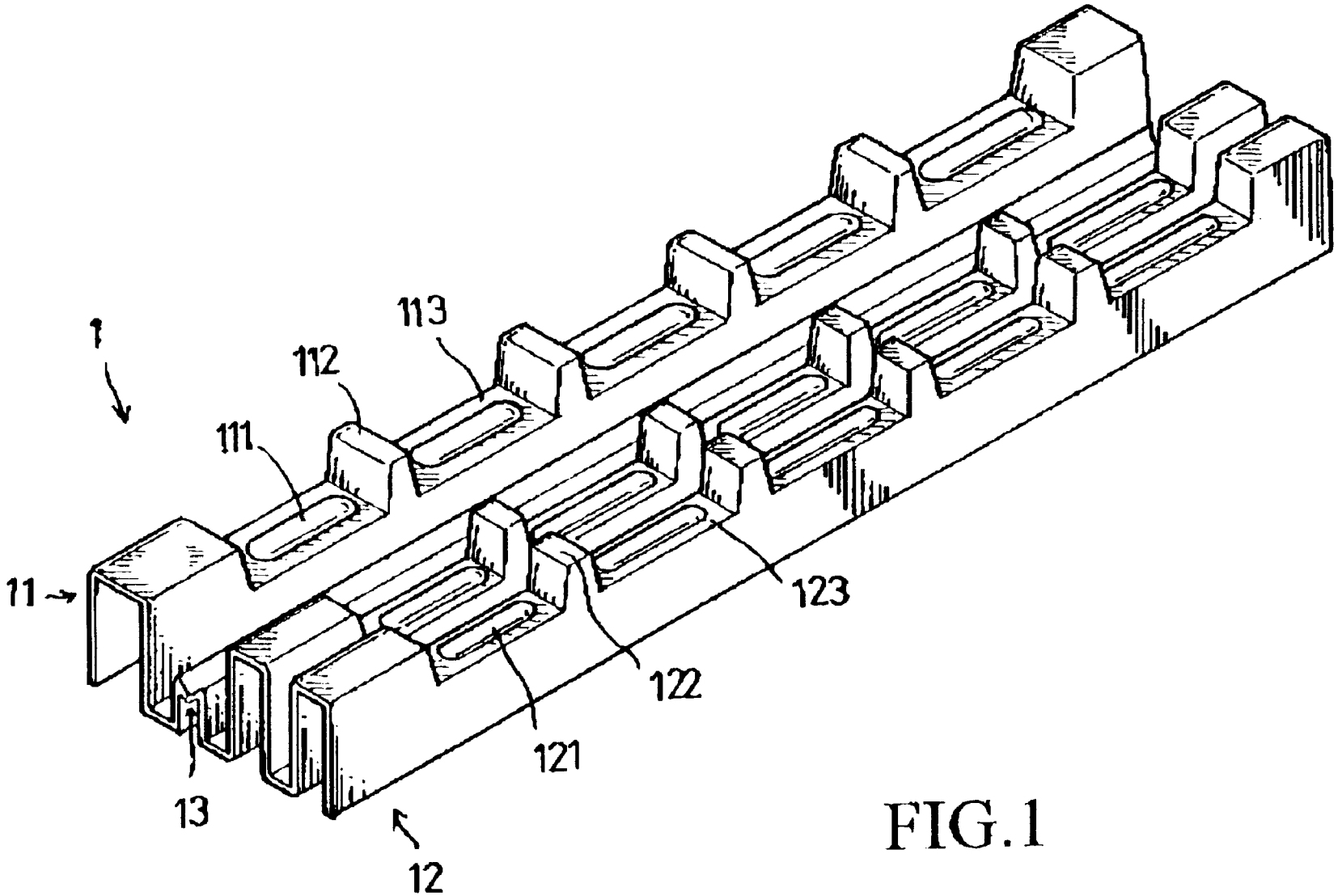
FIG. 1 shows a perspective view, according to the preferred embodiment of the invention.

Referring to FIG. 1, the convertible board holder 1 comprises a first portion 11, a second portion 12 and a hinged portion 13. The first portion 11 has a plurality of ribs 112. A first transverse recess 113 is formed between two ribs 112, and is used to contain, position and cushion article. The second portion 12 has a plurality of ribs 122 corresponding to the ribs 112 of the first portion 11. A second transverse recess 123 is formed between two ribs 122, and is used to contain, position and cushion article. The hinged portion 13 continuously connects between the first portion 11 and the second portion 12 in a corrugated form so that when the first portion 11 and the second portion 12 are rotationally converted about the hinged portion 13 at a certain angle, the first transverse recess 113 and second transverse recess 123 are adapted to receive the two side walls of the article, respectively.

As shown in FIG. 1, the first portion 11 further comprises a projection 111 to further support and cushion the article. The second portion 12 further comprises a projection 121 to further support and cushion the article. The projections 111 and 121 are formed in the transverse recess of the first portion 11 and the second portion 12, respectively. To improve the cushioning effect, a transverse recess can have a plurality of projections.

The first portion 11 and the second portion 12 have at least one base. The number of the base can be adjusted according to the weight and volume of article. The structure of the convertible board holder can be improved to increase the positioning and cushioning effect by adjusting the number of the base. For example, the first portion 11 only has a base; the second portion 12 has two bases.

Figure 2A:
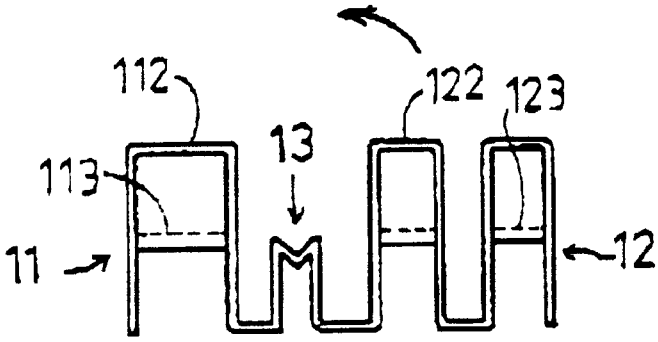
FIG. 2A shows a cross-section view, according to the preferred embodiment of the invention.
Figure 2B:
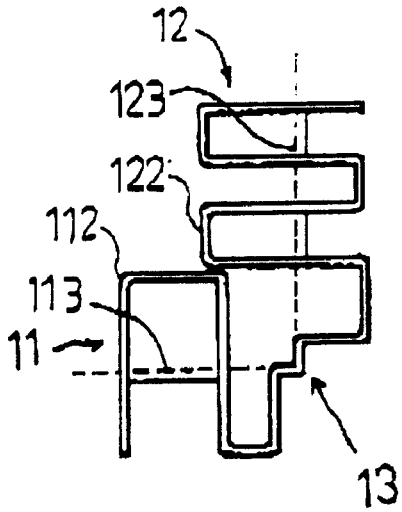
FIG. 2B shows a cross-section view after the convertible board holder is converted, according to the preferred embodiment of the invention.

Referring to FIG. 2A, the hinged portion 13 is formed with a generally M-shaped configuration and connects the first portion 11 and the second portion 12. Referring to FIG. 2B, the first portion 11 and the second portion 12 are rotationally converted about the hinged portion 13 at an angle of 90 degrees to support the article having two continuous side walls of right angle. Therefore, the hinged portion 13 is adapted to position and cushion a corner which the two sides of the article meet after the first portion 11 and second portion 12 are converted.

Figure 3:
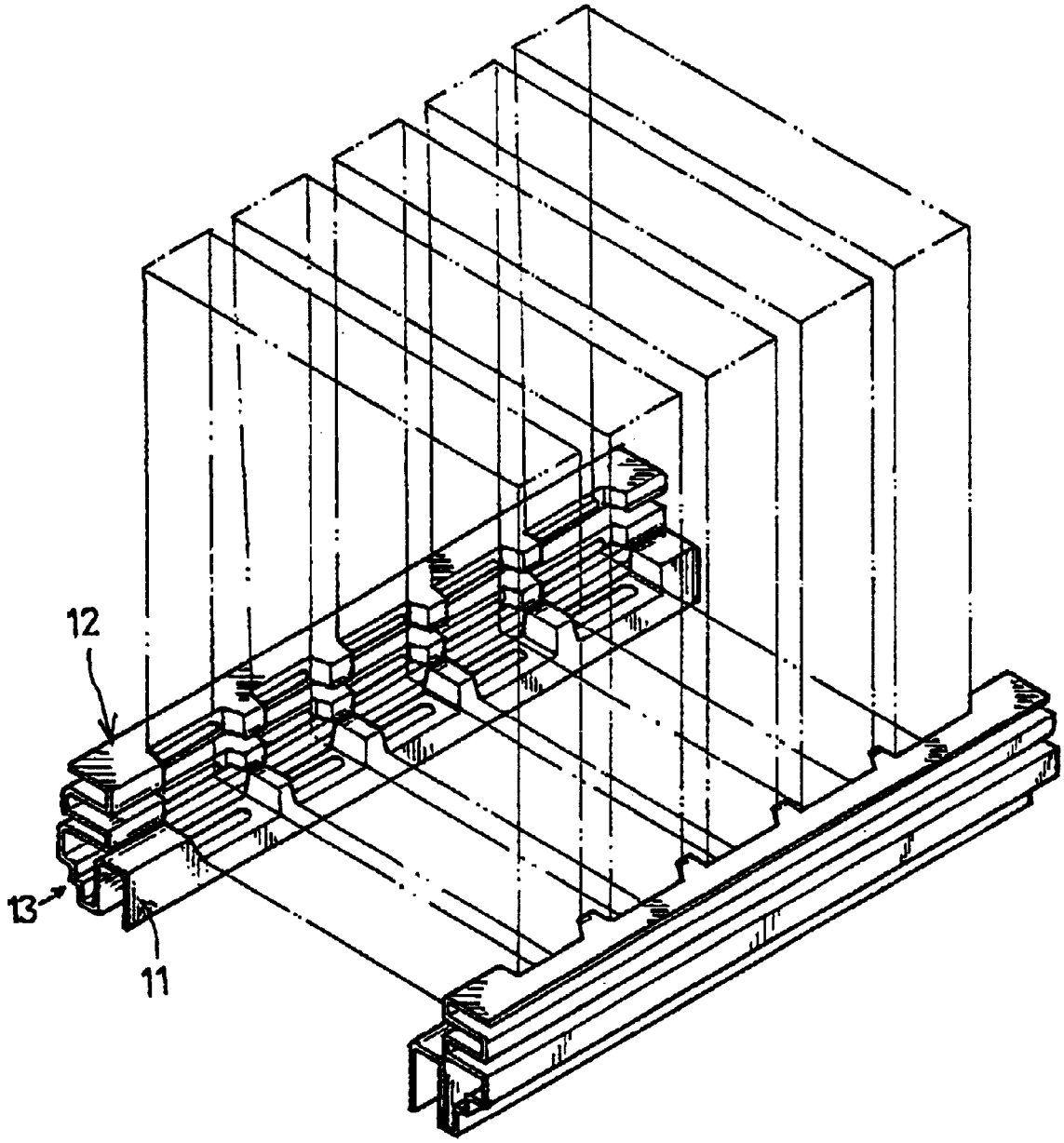
FIG. 3 shows that the convertible board holder packages a plurality of articles, according to the preferred embodiment of the invention.

The first portion 11 and the second portion 12 of the convertible board holder 1 respectively comprise five columns of transverse recesses 113 and 123. The ribs 112 and 122 are used to separate the articles for packaging. The convertible board holder 1 of the invention can package a plurality of articles. As shown in FIG. 3, the convertible board holder 1 of the invention can package five articles. The convertible board holder 1 contains a corner of the article after the convertible board holder 1 is converted. The hinged portion 13 contains the corner of article, and positions and cushions the corner of article. The first portion 11 and the second portion 12 contact and contain at least two side walls of articles, and position and cushion at least two side walls of articles. The ribs 112 and 122 are used to separate two adjacent articles for further positioning and cushioning articles.

The convertible board holder 1 can package at least two side walls of an article after convertible board holder 1 is converted. Compared with the conventional packaging element, the convertible board holder does not need complex manufacturing and packaging processes. The convertible board holder on the invention is manufactured and converted to provide the positioning and cushioning. Therefore, the cost of the convertible board holder is low and the effect of the convertible board holder can be improved.

While an embodiment of the present invention has been illustrated and described, various modifications and improvements can be made by those skilled in the art. The embodiment of the present invention is therefore described in an illustrative but not restrictive sense. It is intended that the present invention may not be limited to the particular forms as illustrated, and that all modifications which maintain the spirit and scope of the present invention are within the scope as defined in the appended claims.

What is claimed is:

1. A convertible board holder for positioning and cushioning at least one article having two continuous side walls, comprising:

a first portion, having at least one first transverse recess;

a second portion, having at least one second transverse recess formed corresponding to the first transverse recess;

a hinged portion, continuously connected between the first portion and the second portion in a corrugated form so that when the first portion and the second portion are rotationally converted about the hinged portion at a certain angle, the first transverse recess and second transverse recess are adapted to receive the two side walls of the article, respectively, the hinged portion formed with a generally M-shaped configuration so that the hinged portion is adapted to position and cushion a corner which the two sides of the at least one article meet after the first portion and second portion are converted.

2. The convertible board holder according to claim 1, wherein the first portion further comprises at least one projection formed in the first transverse recess to further cushion the at least one article.

3. The convertible board holder according to claim 1, wherein the second portion further comprises at least one projection formed in the second transverse recess to further cushion the at least one article.

4. The convertible board holder as claimed in claim 1, wherein the first portion and the second portion are rotationally converted about the hinged portion at an angle of 90 degrees to support the at least one article having two continuous side walls of right angle.

5. The convertible board holder as claimed in claim 1, wherein the holder is provided for allocating a plurality of articles, and wherein the first portion has a plurality of first transverse recesses with a plurality of ribs disposed to separate the first transverse recesses apart from each other, whereas the second portion has a plurality of second transverse recesses with a plurality of corresponding ribs disposed to separate the second transverse recesses apart from each other.

* * * * *